United States Patent [19]

Braverman et al.

[11] Patent Number: 5,062,230

[45] Date of Patent: Nov. 5, 1991

[54] PEN GUN

[75] Inventors: Robert J. Braverman, Marblehead; Isaak M. Shklyarov, Boston, both of Mass.

[73] Assignee: R. J. Braverman Corp., Winthrop, Mass.

[21] Appl. No.: 608,707

[22] Filed: Nov. 5, 1990

[51] Int. Cl.[5] ..... F41C 9/02

[52] U.S. Cl. ..... 42/1.09

[58] Field of Search ..... 42/1.09, 1.08, 1.15, 42/1.16

[56] References Cited

U.S. PATENT DOCUMENTS

| | | | |
|---|---|---|---|
| 1,608,359 | 11/1926 | Biason | 42/1.09 |
| 1,664,049 | 3/1928 | Sedgley | 42/1.09 |
| 1,752,178 | 3/1930 | Huguenin | 42/1.09 |
| 1,772,656 | 8/1930 | Abbott | 42/1.08 |
| 1,877,710 | 9/1932 | Williams, Jr. | 42/1.08 |
| 1,897,992 | 2/1933 | Ailes | 42/1.08 |
| 2,844,902 | 7/1958 | Gaylord, Jr. et al. | 42/1.09 |
| 4,490,935 | 1/1985 | Plachy | 42/1.09 |

*Primary Examiner*—Charles T. Jordan

[57] ABSTRACT

A highly concealable, hand held, single shot weapon of novel design having the appearance and esthetics of a pen like instrument which can be actuated by simultaneously pulling the trigger collar forward and the rear housing rearward in one quick motion. In this position the weapon is in the ready to fire position and can be held in the palm of the head safely, indefinitely. The weapon can either be fired or put into a safe position. To fire, using the thumb and fore finger pull the trigger collar rearward which releases the compressed firing pin assembly to slide forward into the cartridge. To put the weapon into a safe position, turn the trigger collar counter clockwise which sets the control slot of the trigger collar into a position against a set screw that will not allow it to slide rearward.

2 Claims, 1 Drawing Sheet

PEN GUN

BACKGROUND OF THE INVENTION

This invention relates to a single shot pistol in which the gun barrel, stock, and other parts thereof are formed and axially aligned to simulate the appearance of a conventional pen like instrument of the type with a clip which can easily be carried and concealed in the pockets of garments. Here to fore, guns of this type, generally referred to as "pen guns", have been of uninspired and unsafe design. In U.S. Pat. No. 1,608,359 issued to Sergio M. Biason in 1926, a pen gun devise is shown that combines a writing instrument with a mechanism for firing a single bullet. In U.S. Pat. No. 1,664,049 issued to Reginald F. Sedgley in 1928, the inventor creates a pen gun that is a firearm designed to appear as a writing instrument for concealment purposes. This firearm is an improvement over Mr. Biason's design in that the firing and handling of this weapon is more comfortable and less prone to accidental firing. In U.S. Pat. No. 2,844,902 issued to Gaylord Tollinger in 1954, we have a pen gun with the appearance of a pen for concealment purposes. In U.S. Pat. No. 4,490,935 issued to Joseph Planchy in 1985, we have a combination writing instrument and firearm. This invention is a design improvement in that it has no external protrusions which greatly improves its pen like appearance.

The present invention overcomes the problems of the prior pen gun inventions by providing a smooth modern appearance, a simple but effective safety mechanism, a more effective trigger cocking mechanism, and can be comfortably held in the firing position safely with one hand for an indefinate period of time.

SUMMARY OF THE INVENTION

This invention relates to a concealed single shot weapon commonly referred to as a "pen gun", which has the esthetic appearance of a pen like instrument, which can be concealed in the pockets of a person's clothing. This invention is comprised of three body members made of a rigid material that is elongated and cylindrical and has a hollow center passage. The front member, a chamber area for receiving a single cartridge, and commonly referred to as the barrel is threaded on one end for engagement with a central member. This central member, threaded to engage the barrel, is the main body of the firearm which houses the firing pin carrier assembly. The third body member is the rear housing and is used to cock the firing pin assembly into a ready to fire position. The rear housing, which is the handle of this weapon, is made to slip over the internal section of the main body and the rear section of the firing pin assembly. This present invention provides a pistol device of novel construction and arrangement embodying a firing pin carrier assembly mounted for reciprocative movement within a central body member. The firing pin assembly has been adapted to be manually moved rearward to a retracted and cocked position by grasping the trigger collar in the center of the device in one hand and pulling forward while grasping the rear housing with the other hand and pulling rearward, thus locking the firing pin assembly behind a ball bearing which is forced down into a groove cut into the front end of the firing pin assembly. The weapon cannot be fired until the trigger collar is pulled rearward which then allows the ball bearing to be forced upwards into a recessed cavity on the inside surface of the trigger collar by the force exerted on it by the compressed firing pin assembly spring, which also forces the firing pin assembly forward into the breech block. The breech block is provided with an aperture through which the firing pin will extend through and contact the cartridge with sufficient kinetic energy causing the weapon to fire.

OBJECTS AND ADVANTAGES

It is an object of this invention:

1. To provide a safe and useful firearm which can be carried on the person and be used as an effective emergency defense weapon.

2. Another object of this invention is to provide a smooth, clean, modern design of a pen like instrument which is highly concealable.

3. Another object of this invention is to improve the engineering design of previous pen gun patents by removing external protruding firing mechanisms that must be held in the firing position by the thumb or held in a firing position using two hands.

4. Another object of this invention is to offer an improved pen gun design which incorporates a true safety mechanism which allows the weapon to be carried in a cocked and ready to fire position and can be safely discharged using one hand.

5. Another object of this invention is to offer an improved pen gun design that offers a simple, and straight forward mechanical design that embodies all the benefits of a safe, effective, reliable firearm.

6. Another object of this invention is to provide a pen gun device which is relatively simple, and inexpensive to manufacture.

In accordance with these and other objects which will become apparent hereinafter, this pen gun design will now be described with particular reference to the accompanying drawings.

DRAWING FIGURES

DRAWING REFERENCE NUMBERS

Figure 1:
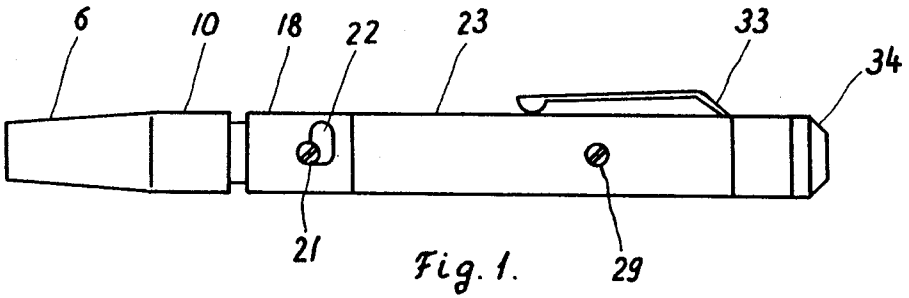
FIG. 1 Shows a side elevational view of the present invention.

6 barrel
7 barrel bore
8 cartridge
9 threaded connection; barrel to main body
10 main body
11 breech block
12 breech block aperture
13 firing pin
14 groove in forward section of firing pin assembly
15 ball bearing
16 recessed cavity on internal surface of trigger collar
17 ball bearing passageway in main body internal section 18 trigger collar
19 firing pin assembly
20 motion restriction slot in firing pin assembly
21 set screw
22 control slot in trigger collar
23 rear housing
24 main body internal section
25 firing pin assembly spring
26 rear rod section of firing pin assembly
27 threaded retaining collar for firing pin assembly spring
28 anti-rotation slot in rod section of firing pin assembly
29 anti-rotation set screw
30 rear housing spring
31 retaining ring for rear housing spring
32 threaded connection; rear housing to rear cap
33 pen clip
34 rear cap

PREFERRED EMBODIMENT OF THE INVENTION

Referring to the drawings, the present invention, the single shot pistol is shown on FIG. 1 comprising a barrel 6 mounted in axial alignment on the forward end of the main body 10 and the rear housing 23 to simulate the appearance of a pen like instrument. The trigger collar 18 has been fit into the main body 10 to be unobtrusive and pen clip 33 has been added which further adds to its pen like appearance.

Figure 2:
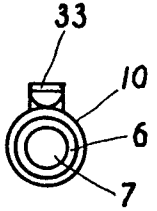
FIG. 2 Shows an end elevational view showing the barrel end of the present invention.
Figure 3:
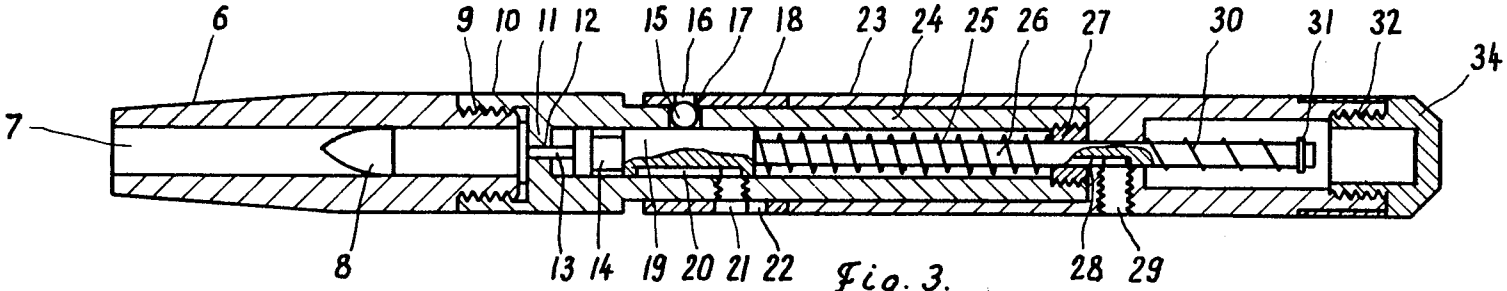
FIG. 3 Shows a side elevational view in cross section showing the present invention in the firing position, with the firing pin striking the cartridge.
Figure 4:
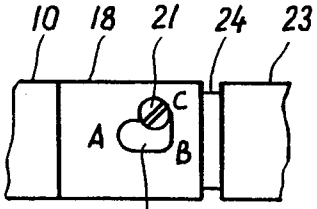
FIG. 4 Shows a side elevational view of the present invention in a ready to fire position, with the trigger collar in the safe position.
Figure 5:
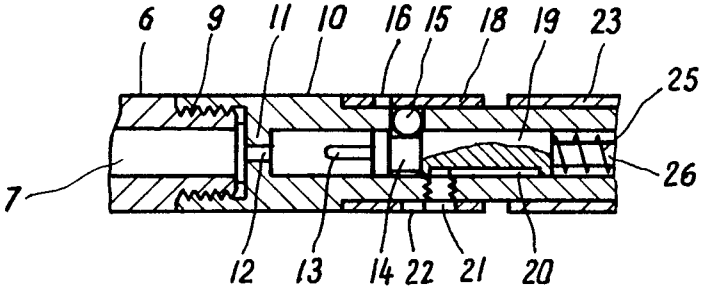
FIG. 5 Shows a side elevational view in cross section showing the firing pin assembly being held by the ball bearing in a ready to fire position.

FIG. 2 shows the front end view of the invention straight along the axis showing the barrel bore 7, barrel 6, main body 10, and pen clip 33. Referring now to FIGS. 3 & 5, the internal mechanism of the device is shown. The forward end of the main body 10 is threaded 9 to which barrel 6 is mounted in axial alignment. The barrel 6 is formed with a bore 7 and an area to snugly receive a cartridge 8. The main body 10 is provided with a breech block 11 formed with an aperture 12 to slidably receive the firing pin 13 mounted on the forward end of the firing pin assembly 19. The main body 10 has an internal section 24 through which a central passage has been formed disposed from the breech block 11 and terminating rearward into the rear housing 23 at the rear cap 34. The firing pin assembly 19 is comprised of the firing pin 13, groove 14, motion restriction slot 20, rear rod section 26, anti-rotation slot 28, compression spring 25, retaining ring 27, rear housing spring 30, retaining ring 31, and can move slidably rearward and forward. The rear housing 23 is a cylindrical rigid member which has been hollowed to encase the interior main body section 24 and rear rod section 26 and rear housing spring 30. The rear housing 23 is connected to the rear cap 34 by threaded connection 32 and is held from rotating laterally by set screw 29 which is recessed in slot 28 in rear rod section 26. The rear housing 23 moves slidably rearward which compresses spring 30 against retaining ring 31. This rearward action then retracts the firing pin assembly 19 and compresses spring 25. When this rearward pull of the rear housing 23 is done in conjunction with sliding the trigger collar 18 forward the ball bearing 15 is forced down from its position in recessed cavity 16 through passageway 17 into the firing pin assembly groove 14. The ball bearing 15 will then be held in the groove 14 as trigger collar 18 is slid forward and rotated counter clockwise by use of an L shaped slot 22, whose movement is controlled by set screw 21 which extends through the main body 10 into firing pin slot 20 which restricts the forward movement of the firing pin assembly 19. The gun is now locked into a retracted and ready to fire position. The rear housing 23 is then forced forward by the compressed spring 30 back into a neutral position. To understand the relationship between the trigger collar 18 and the firing pin assembly 19 look at FIG. 5. As can be seen, the firing pin assembly is in the ready to fire position. This was done by simultaneously pulling the rear housing 23 rearward and pulling the trigger collar 18 forward. The ball bearing 15 is then forced into the firing pin groove 14. In FIG. 4 you can see the L slot 22, set screw 21, and positions A, B & C. The trigger collar 18 has been slid forward and has been turned counter clockwise to position C, the safe position. The trigger collar 18 is held firmly in place by friction created by ball bearing 15 which is sandwiched between trigger collar 18 and the firing pin assembly 19. To fire the embodiment, turn trigger collar 18 clockwise so set screw 21 is at position B, then slid collar rearward so set screw 21 is at position A; the gun has fired as shown on FIG. 3. The trigger collar 18 has been pulled rearward which aligned a recessed cavity 16 on the inside surface of the trigger collar 18 to passageway 17. The ball bearing 15 is forced upwards into the recessed cavity 16. The compression of spring 25 which helped force the ball bearing 15 upward, forces the firing pin assembly 19 forward with sufficient kinetic energy, causing the firing pin 13 through the breech block aperture 12, hitting cartridge 8, causing it to fire. While the above description contains many specificities, the reader should not construe these as limitations on the scope of the invention, but merely as exemplifications of preferred embodiments thereof. Those skilled in the art will envision many other possible variations are within its scope. For example skilled artisans will readily be able to change the dimensions and shapes of the various embodiments. They will be able to make this firearm of many alternative materials such as modern plastics, and can make variations on the firing pin mechanism, trigger collar and safety design, and the use of set screws to restrict motion. The invention has been shown and described herein in what is considered to be the most practical and preferred embodiment. Accordingly, the scope of the invention should be determined by the embodiments illustrated, the claims and their legal equivalents.

Having thus described the invention, we claim as new and desire to secure by Letters Patent.

1. A single shot pistol which simulates the appearance of a modern pen like instrument, comprised of a barrel adapted to receive a cartridge and threadably connected to a main body having coaxial front and rear bores spaced apart by a breech block with an aperture through which a firing pin assembly which is mounted for reciprocative movement in said rear bore can project a firing pin through said aperture and engage and fire said cartridge after the firing pin assembly has been retracted and locked into a ready to fire position by simultaneously pulling a trigger collar forward and a rear housing rearward which causes the firing pin assembly to be locked behind a ball bearing which is forced down into a groove in the firing pin assembly until it is released by sliding the trigger collar rearward causing the ball bearing to be forced upwards into a recessed cavity on the interior surface of the trigger collar causing a compressed firing pin spring to force the firing pin assembly forward with sufficient force to fire said cartridge.

2. A single shot pistol which simulates the appearance of a modern pen like instrument, comprised of a barrel adapted to receive a cartridge and threadably connected to a main body having coaxial front and rear bores spaced apart by a breech block with an aperture through which a firing pin assembly which is mounted for reciprocative movement in said rear bore can project a firing pin through said aperture and engage and fire said cartridge after the firing pin assembly has been retracted and locked into a ready to fire position by simultaneously pulling a trigger collar forward and a rear housing rearward which causes the firing pin assembly to be locked behind a ball bearing which is forced down into a groove in the firing pin assembly until it is released by turning the trigger collar clockwise out of a safe position then sliding the trigger collar rearward causing the ball bearing to be forced upwards into a recessed cavity on the interior surface of the trigger collar causing a compressed firing pin spring to force the firing pin assembly forward with sufficient force to fire said cartridge.

* * * * *